US009200478B2

(12) United States Patent
Connell

(10) Patent No.: US 9,200,478 B2
(45) Date of Patent: Dec. 1, 2015

(54) LATCH MECHANISM

(71) Applicant: Control Techniques Limited, Newtown (GB)

(72) Inventor: Hugh A. Connell, Evesham (GB)

(73) Assignee: CONTROL TECHNIQUES LIMITED, Newton (GB)

( * ) Notice: Subject to any disclaimer, the term of this patent is extended or adjusted under 35 U.S.C. 154(b) by 111 days.

(21) Appl. No.: 13/775,902

(22) Filed: Feb. 25, 2013

(65) Prior Publication Data

US 2013/0234451 A1 Sep. 12, 2013

(30) Foreign Application Priority Data

Feb. 24, 2012 (GB) ..... 1203334.6

(51) Int. Cl.

| | |
|---|---|
| ***E05C 3/06*** | (2006.01) |
| ***E05C 3/14*** | (2006.01) |
| ***E05B 17/20*** | (2006.01) |
| *E05B 35/00* | (2006.01) |
| *E05C 19/00* | (2006.01) |
| *E05B 15/02* | (2006.01) |
| *E05B 15/04* | (2006.01) |

(52) U.S. Cl.

CPC ..... *E05C 3/145* (2013.01); *E05B 17/2019* (2013.01); *E05B 35/008* (2013.01); *E05B 2015/023* (2013.01); *E05B 2015/0468* (2013.01); *E05C 19/006* (2013.01); *Y10T 29/49826* (2015.01); *Y10T 292/1078* (2015.04)

(58) Field of Classification Search

CPC ..... H05K 5/0221; H05K 5/0013

See application file for complete search history.

(56) References Cited

U.S. PATENT DOCUMENTS

| | | | | |
|---|---|---|---|---|
| 5,603,535 | A * | 2/1997 | Antonucci et al. | 292/128 |
| 8,252,454 | B2 | 8/2012 | Jiang | |
| 2009/0290322 | A1 | 11/2009 | Chang | |

FOREIGN PATENT DOCUMENTS

| | | |
|---|---|---|
| GB | 2342118 | 4/2000 |

* cited by examiner

*Primary Examiner* — Mark Williams

(74) *Attorney, Agent, or Firm* — Harness, Dickey & Pierce, P.L.C.

(57) ABSTRACT

A latch mechanism is provided comprising a latch and a cover arranged for attachment to the latch. The latch includes a latch body and a projection extending therefrom wherein, when the latch and cover are attached to one another, the projection extends from an inner surface of the cover. The latch mechanism further comprises a docking area located on a device, the docking area being arranged to receive the latch such that the cover may be securely fixed to the device. When the cover is placed over the docking area, a sliding movement of the cover causes actuation of the latch to secure the cover to the docking area. When the cover is secured in the docking area, further sliding movement of the cover is prevented.

20 Claims, 12 Drawing Sheets

LATCH MECHANISM

CROSS-REFERENCE TO RELATED APPLICATION

This application claims the benefit and priority of Great Britain Patent Application No. GB 1203334.6 filed Feb. 24, 2012. The entire disclosure of the above application is incorporated herein by reference.

FIELD

The invention relates to a latch mechanism. In particular it relates to a latch for use with a cover and a drive unit.

BACKGROUND INFORMATION

It is common for electrical devices and other sensitive devices to require a cover to provide both protection of the device and safety for the user of the device. Generally, the covers of such devices are required to be removable such that the device is accessible for maintenance or alteration, for example. Conventionally, fittings such as screws are used so that the cover may be securely attached to the device while still allowing the possibility of removing and replacing the cover. Electrical standards also require the cover to be tool-removable.

The removal of screws is a time consuming process requiring the individual removal of often a large number of screws manually. Additionally, the screws are easily lost or dropped inside the device which may cause damage to the device and produce additional safety risks to the user. The loss of one or more screws impacts the effectiveness of the device cover permanently unless the screw is replaced. Continual removal and replacement of screws may also lead to the screw heads becoming damaged, thereby rendering removal of the screws and device cover impossible.

There is a desire for a means of attaching a cover to a device that is quick, safe and efficient.

SUMMARY

An invention is set out in the claims.

According to an aspect there is provided a latch mechanism comprising a latch and a cover arranged for attachment to said latch. The latch itself includes a latch body and a projection extending therefrom wherein, when the latch and cover are attached to one another, the projection extends from an inner surface of the cover. The latch mechanism further comprises a docking area located on a device, said docking area being arranged to receive the latch such that the cover may be securely fixed to the device. The docking area includes a guiding hole comprising a first hole portion and a second hole portion, each arranged to receive the projection which extends from the latch body. When the cover is placed over the docking area and the projection is received in the first hole portion, a sliding movement of the cover causes actuation of the latch so that the projection moves from the first hole portion to the second hole portion wherein, when the latch is received in the second hole portion, further sliding movement of the cover is prevented. Preferably the latch is rotatable with respect to the cover and comprises a release arm and a stopping arm, both extending from the latch body. The docking area or cover may comprise a guiding structure including a first, wedge-shaped portion and a second portion comprising a guiding edge. Actuation of the latch may cause a distal end of the stopping arm to sit in a seat formed between the wedge-shaped portion and the guiding edge of the guiding structure thereby locking the latch to the cover.

The docking area may comprise an obstructing protrusion positioned to abut against the release arm of the latch after a predetermined actuation of the latch, wherein said abuttal provides a force to help release the cover from the device.

The latch may comprise a first formation extending from the latch. Alternatively, the first formation may be incorporated into the release arm. The cover may comprise a second, co-operating formation wherein the first formation will contact the second co-operating formation during actuation of the latch, in order to limit the extent of the actuation of the latch. The second formation may instead be located on the docking area to perform the same function.

The latch may comprise opposite first and second faces, said first face having the projection and said second face having a protrusion thereon. The latch may comprise a slot to enable rotation of the latch via a tool. The slot may be shaped to accommodate the head of a screwdriver, and may be located on the protrusion. Alternatively, the protrusion may be shaped to be rotatable by a tool directly.

The cover may comprise one or more hooks extending from said cover and the docking area may comprise one or more retention holes arranged to receive one or more of the hooks on the cover.

According to another aspect there is provided a method of fixing a cover to a device via a latch mechanism, said latch mechanism comprising a latch securely fitted to a cover, said latch including a latch body and a projection extending from an inner surface of the cover. The method comprises fitting the latch and the cover to a docking area located on a device, said docking area being arranged to receive the latch such that the cover may be securely fitted to the device. The docking area includes a guiding hole comprising a first hole portion and a second hole portion, each arranged to receive the projection. The fitting includes placing the cover over the docking area such that the projection is received in the first hole portion and sliding the cover to cause the actuation of the latch so that the projection moves from the first hole portion to the second hole portion wherein, when the latch is received in the second hole portion, further sliding of the cover is prevented.

According to another aspect the device to which the cover is fixed is a drive unit.

According to another aspect there is provided an assembly including a device and a cover fitted to the device via a latch mechanism as described herein.

FIGURES

Embodiments and examples will now by described with respect to the appended figures of which:

FIG. 1*a* shows an example latch, cover and drive unit configuration;

FIG. 1*b* shows a flow diagram showing the operation steps of the latch mechanism;

FIG. 1*c* shows a latch;

FIG. 2*a* shows a cover for use in conjunction with the latch of FIG. 1*c;*

FIG. 2*b* shows a plan view of the latch of FIG. 1*c* attached to the cover of FIG. 2*a* and in a "relaxed" position;

FIG. 2*c* shows a plan view of the latch of FIG. 1*c* attached to the cover of FIG. 2*a* and in an "operating" position;

FIG. 3*a* shows a drive unit docking area for use in conjunction with the cover of FIG. 2*a* and the latch of FIG. 1*c;*

FIG. 3*b* shows a close up view of the docking area of FIG. 3*a;*

FIG. 4*a* shows a plan view of the guiding bar of the latch of FIG. 1*c* in the guiding hole of the docking area of FIG. 3*a* in an "open" position;

FIG. 4*b* shows a plan view of the guiding bar of the latch of FIG. 1*c* in the guiding hole of the docking area of FIG. 3*a* in an "intermediate" position;

FIG. 4*c* shows a plan view of the guiding bar of the latch of FIG. 1*c* in the guiding hole of the docking area of FIG. 3*a* in a "closed" position;

OVERVIEW

Figure 1A:
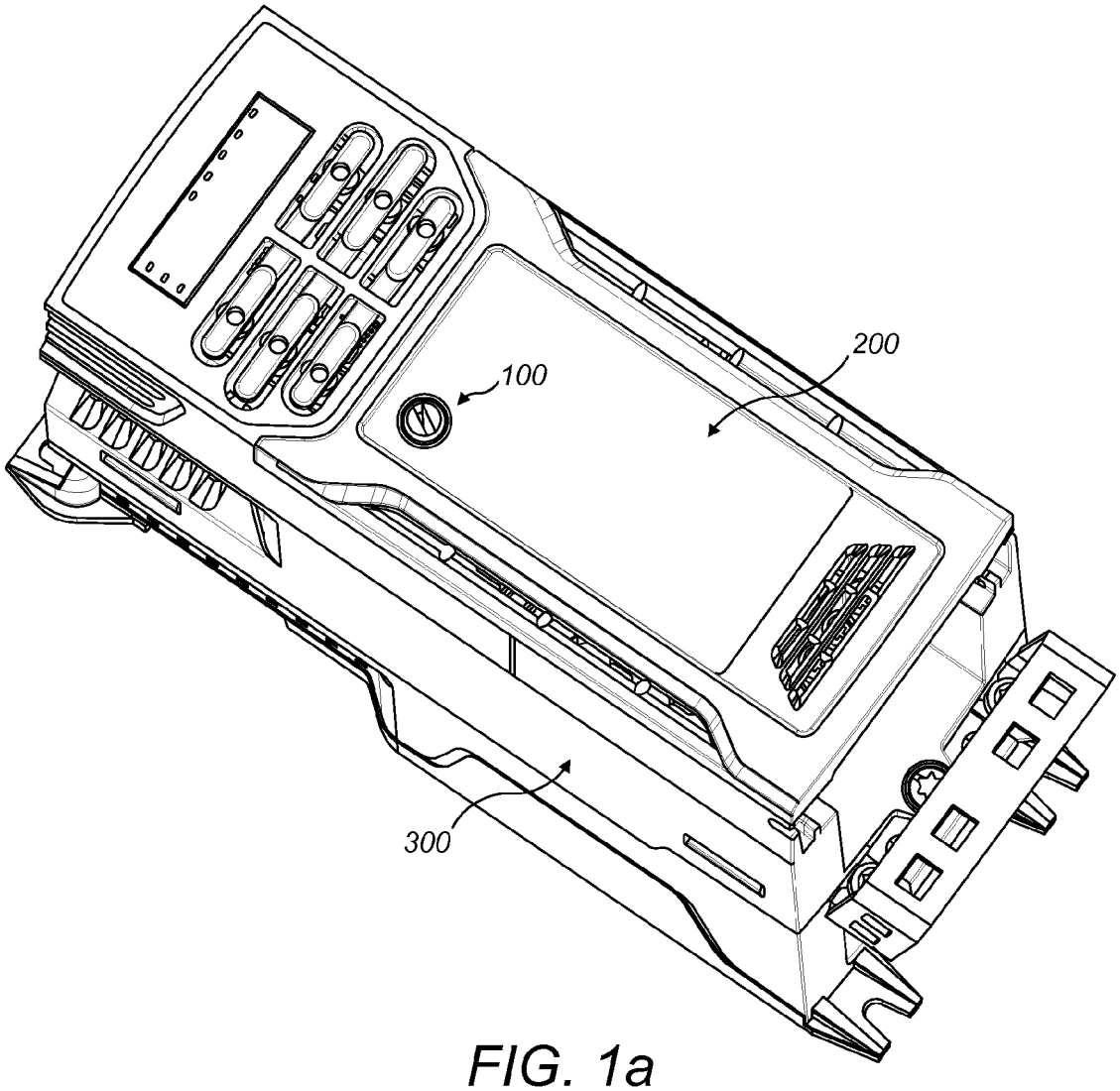

In overview there is provided a latch for fixing a cover to a unit such as a drive unit, as shown for example in FIG. 1*a*. The latch and cover attach to the drive unit by interacting with a docking area located on the drive unit. The docking area comprises a recess and is designed and shaped to enable fixing of the latch and cover to the drive unit without the use of adhesive or other traditional fixings, such as screws.

To fit the cover and latch to the driving unit, a sliding movement of the cover with respect to the drive unit is required. This movement allows hooks located on the cover to enter recesses in the drive unit. It also actuates the latch to lock it into position within the docking area. The interaction of the drive unit, the latch and the cover prevents the release of the cover from the drive unit without a release rotation of the latch for example by a screwdriver. As such, when the cover slides over the docking area on the drive unit it is locked into place by a combination of the latch and the hooks on the cover.

On rotating the latch in a release direction for example with a screwdriver, the interaction of two arms on the latch, the cover and the docking area causes the cover to automatically slide off, thereby removing the hooks from the recesses in the drive unit and allowing the cover to be removed.

DETAILED DESCRIPTION

The latch mechanism disclosed herein can be better understood with respect to the figures. The latch mechanism system comprises three main elements: a latch 100, a cover 200 and a docking area 300.

Figure 1B:
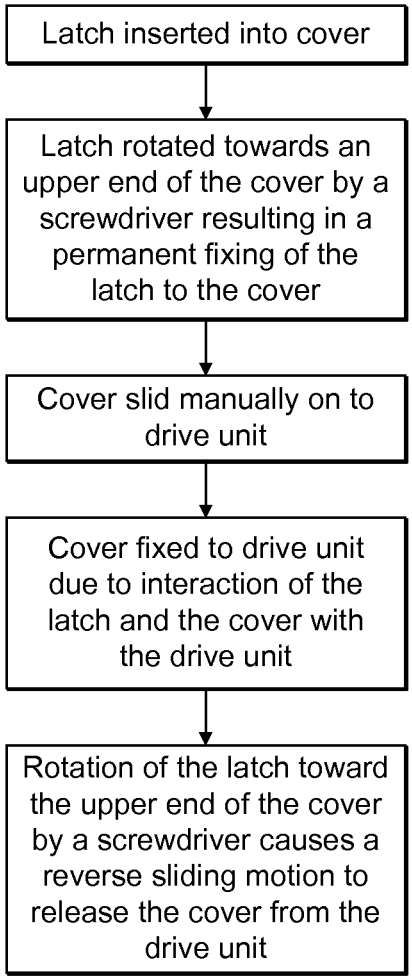

The interaction of the latch 100, the cover 200 and the docking area 300 of a drive unit is represented in the flow diagram shown in FIG. 1*b*. The latch 100 is first inserted into, and then securely fitted to, the cover 200 without the aid of any additional fixing parts such as screws. This fitting of the latch 100 is achieved through a rotation of the latch in situ, after it has been inserted at least partially into an opening in the cover 200. This rotation causes movement of two latch arms that interact with the cover 200 until the latch arms are located in non-return positions within the cover, resulting in a permanent fixing. The cover 200 is then fitted to the drive unit by a manual sliding motion until an outer face of the cover 200 lies substantially flush with an adjacent outer surface of the drive unit. The cover 200 fixes on to the drive unit due to the interaction of the latch 100 and the cover 200 with features within a docking area comprised in the drive unit during the sliding motion.

The cover 200 has a structure which can include hooks 214 that slide into the drive unit such that, when the cover 200 slides over the docking area 300 of the drive unit, the hooks 214 enter retention holes 308 in the drive unit and thereafter the cover 200 can only be removed from the drive unit by an opposite sliding motion followed by a lifting motion. However, the sliding motion during fitting of the cover 200 also causes the latch to rotate and engage with the drive unit. Therefore the cover 200 can only be slidably removed by an opposite rotation of the latch 100 for example using a screw driver. The opposite sliding motion of the cover is provided automatically by the interaction of the latch 100 with the cover 200 and docking area 300 upon such an opposite rotation of the latch 100.

Figure 1C:
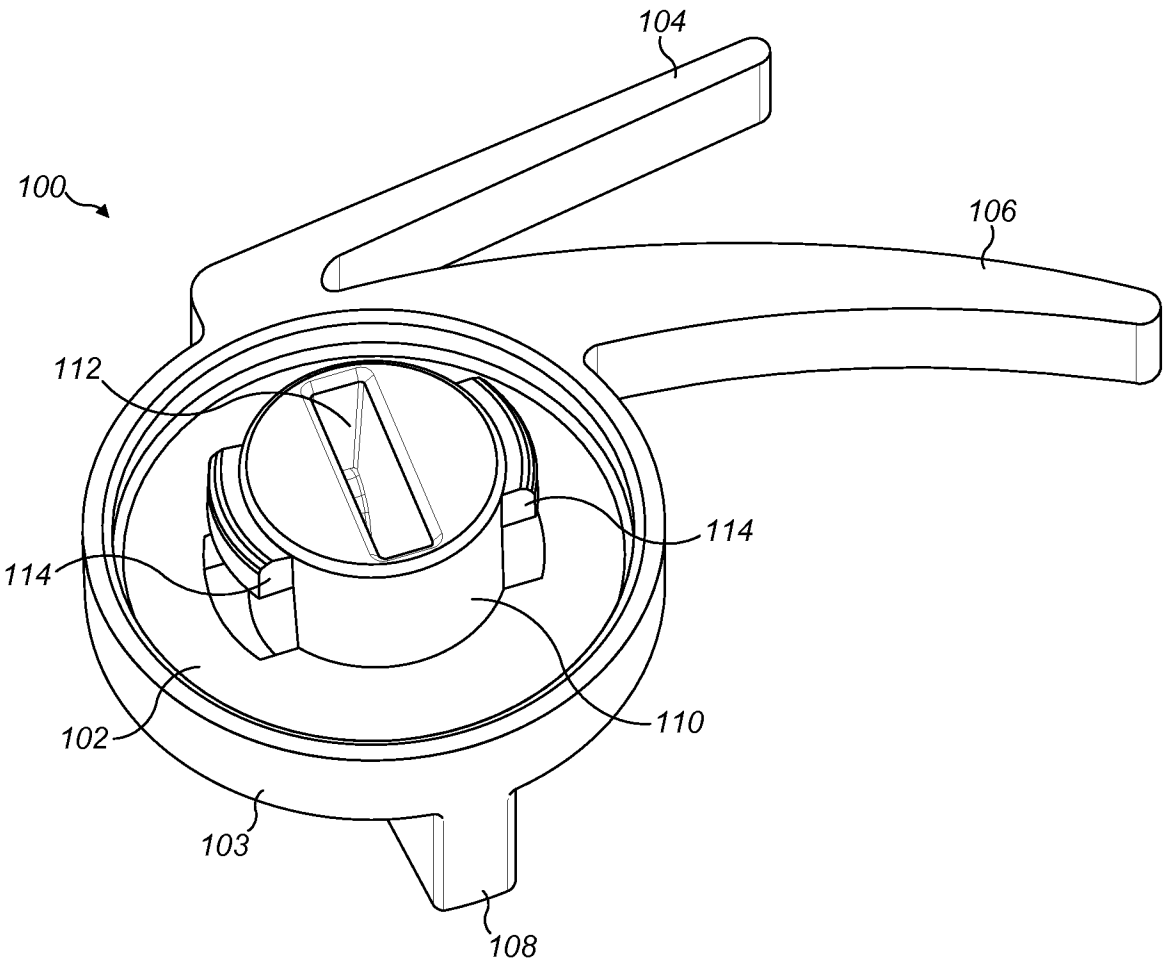

The latch 100 shown in FIG. 1*c* is a mechanical device used for fitting a cover 200 to a drive unit. The latch 100 comprises a body 102, an edge 103, a release arm 104, a stopping arm 106, a guiding bar 108 and a central protrusion 110. In the latch shown in FIG. 1*c*, the body 102 is a circular disk comprising a top face, a bottom face and an edge 103 defined between the top and bottom faces. The release arm 104 is a relatively thin, substantially L-shaped arm extending from the edge 103 of the body 102 with the longer branch of the L-shape extending in a direction substantially tangential to, and coplanar with, the body 102. The stopping arm 106 is a relatively thin, curved and tapered arm initially extending in the same direction as, and located proximal to, the longer branch of the L-shaped release arm 104. The curvature of the stopping arm 106 causes it to deviate away from the release arm 104 along its length, as shown in FIG. 1*c*.

Figure 4C:
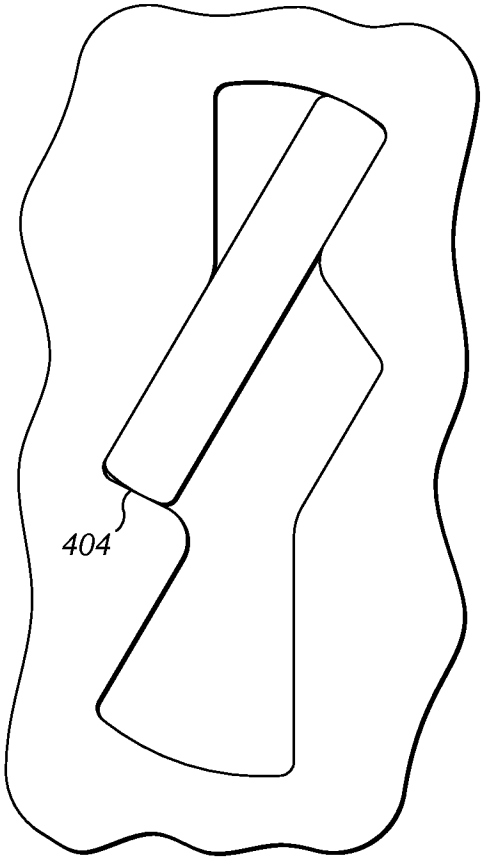

The guiding bar 108 protrudes outwardly from the bottom face of the body 102, as shown in FIG. 1*c*. The guiding bar 108 is substantially rectangular in cross section, wherein the length of the rectangle extends along the diameter of the body 102. In FIG. 1*c* the length of the guiding bar is aligned, along the diameter of the body 102, with a point on the edge 103 at which the release arm 104 attaches to the body 102. The width of the guiding bar 108 is designed such that it fits through a guiding hole 202 in the cover 200, shown in FIGS. 4*a*-4*c*, as described in more detail below.

The central protrusion 110 protrudes upwardly from the top face of the latch body 102, as shown in FIG. 1*c*. The central protrusion 110 is a cylindrical protrusion with an annular wall and substantially circular upper face. It is coaxial with the circular body 102, protrudes perpendicular to the plane of body 102, and has a diameter less than that of the body 102. The central protrusion 110 has a slot defined in its upper face. In FIG. 1*c*, the slot 112 extends across the diameter of the central protrusion 110 and is shaped to accommodate the head of a flat head screwdriver. The slot 112 may be orientated such that it lies parallel to the length of the guiding bar 108 (located on the opposite face of the latch body 102), but may alternatively be orientated in any direction across a diameter of the central protrusion 110. The slot 112 may extend across the entire diameter of the central protrusion 110 or only across a part of it. In another embodiment, the slot 112 is shaped to accommodate the head of a Philips screwdriver. Alternatively, the shape of the slot 112 can be chosen to enable inter-engagement between the slot and another type of tool to allow the tool to rotate the central protrusion 110, via the slot 112. In an embodiment, the central protrusion 110 does not comprise a slot 112 and is shaped to allow a tool to rotate the central protrusion 110 directly. For example, the central protrusion 110 may not be cylindrical, but may be hexagonal such that it can be rotated by a spanner or any other appropriate tool known in the art.

Referring again to FIG. 1*c*, lugs 114 are provided at a top end of the central protrusion 110. The lugs 114 extend radially outward from a top part of the annular wall of the central protrusion 110. In an embodiment, there are two lugs 114 located diametrically opposite one another on the top part of the annular wall, positioned such that the diameter defined between the two lugs 114 lies perpendicular to the length of the guiding bar 108. In another embodiment, the central protrusion 110 only has one lug 114 extending from its annular wall. As will be understood further from the description below, the lug(s) 114 can instead be arranged to be parallel to, or indeed to lie in any other orientation with respect to, the guiding bar 108.

Figure 2A:
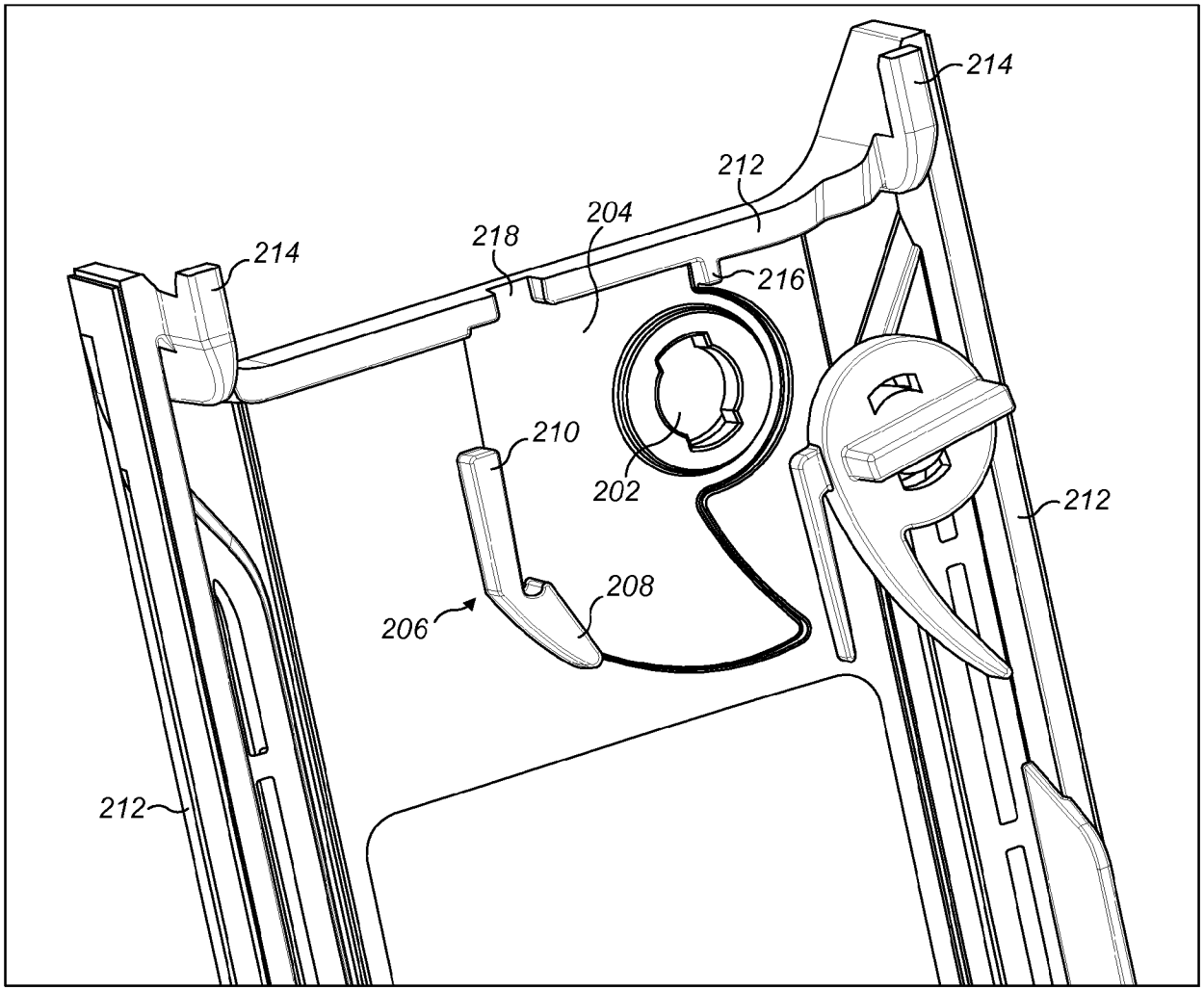

The cover 200 is shown in FIG. 2*a*. The cover comprises an opening 202 for receiving the latch central protrusion 110, a latch receiving area 204 surrounding said opening 202, a guiding structure 206, a frame 212, hooks 214, a stopping lug 216, and a recess 218.

The cover 200 is substantially planar and rectangular in the embodiment of FIG. 2*a*. The frame 212 is a relatively thin structure located around the perimeter of the cover 200. The frame 212 comprises an upper end, located on an upper edge of the cover 200 nearest the latch receiving area 204 of FIG. 2*a*, two side ends located on either side of the cover 200, and a lower end located opposite the upper end. In an embodiment, the frame 212 is raised such that it extends inwardly, perpendicular to the cover 200. One or more sections of the frame 212 can be raised relative to the perimeter of the cover 200 such that they extend inwardly, perpendicular to the cover 200 and sit within the drive unit when the cover 200 is fitted on to the drive unit. When the cover 200 is substantially flush with the drive unit, the one or more raised sections of the frame 212 abut against an inner wall of the drive unit, allowing any side load applied to the edges of the cover 200 to be spread over the cover 200. The raised sections of the frame 212 also act as location features to facilitate correct placement of the cover 200 on the drive unit.

In another embodiment, the raised sections of the frame 212 sit outside the drive unit such that, when the cover 200 is substantially flush to the drive unit, the raised sections of the frame 212 abut with an outer wall of the drive unit. In another embodiment, the frame 212 is not raised and lies substantially flat with the cover 200.

In an embodiment, two hooks 214 are located at the corners where the side ends of the frame 212 meet the upper end of the frame 212. The two hooks 214 extend inwardly perpendicular to the plane of the cover 200 and then bend substantially at a right angle away from, and parallel to, the length of the cover 200. The shaping of the hooks 214 is such that they interact with retention holes 308 on the drive unit. When the cover 200 is fitted to the drive unit, the hooks 214 enter the retention holes 308.

The opening 202 is a hole in the cover 200, sized and shaped to receive the top end of the central protrusion 110 of the latch 100, allowing the insertion of the central protrusion 110 therethrough. Therefore, in FIG. 2*a* the opening 202 is a circular hole with two extended regions located on opposite sides of the circular hole, designed to match the two lugs 114 located on opposite sides of the central protrusion 110 of the latch 100. As such the central protrusion 110 and lugs 114 are able to pass through the opening 202 from the inner surface of the cover 200 until the lugs 114 protrude from the opposite, outer face of cover 200. This insertion causes the latch 100 to align with, and therefore sit within, the latch receiving area 204 of the cover 200. In operation, once the central protrusion 110 of the latch 100 has been inserted into the opening 202, the user must rotate the central protrusion 110 in order to lock the latch 100 to the cover 200. A rotation of the central protrusion 110 causes the lugs 114 to no longer align with the extended regions of the opening 202, therefore preventing movement of the central protrusion 110 back through the opening 202.

Figure 2B:
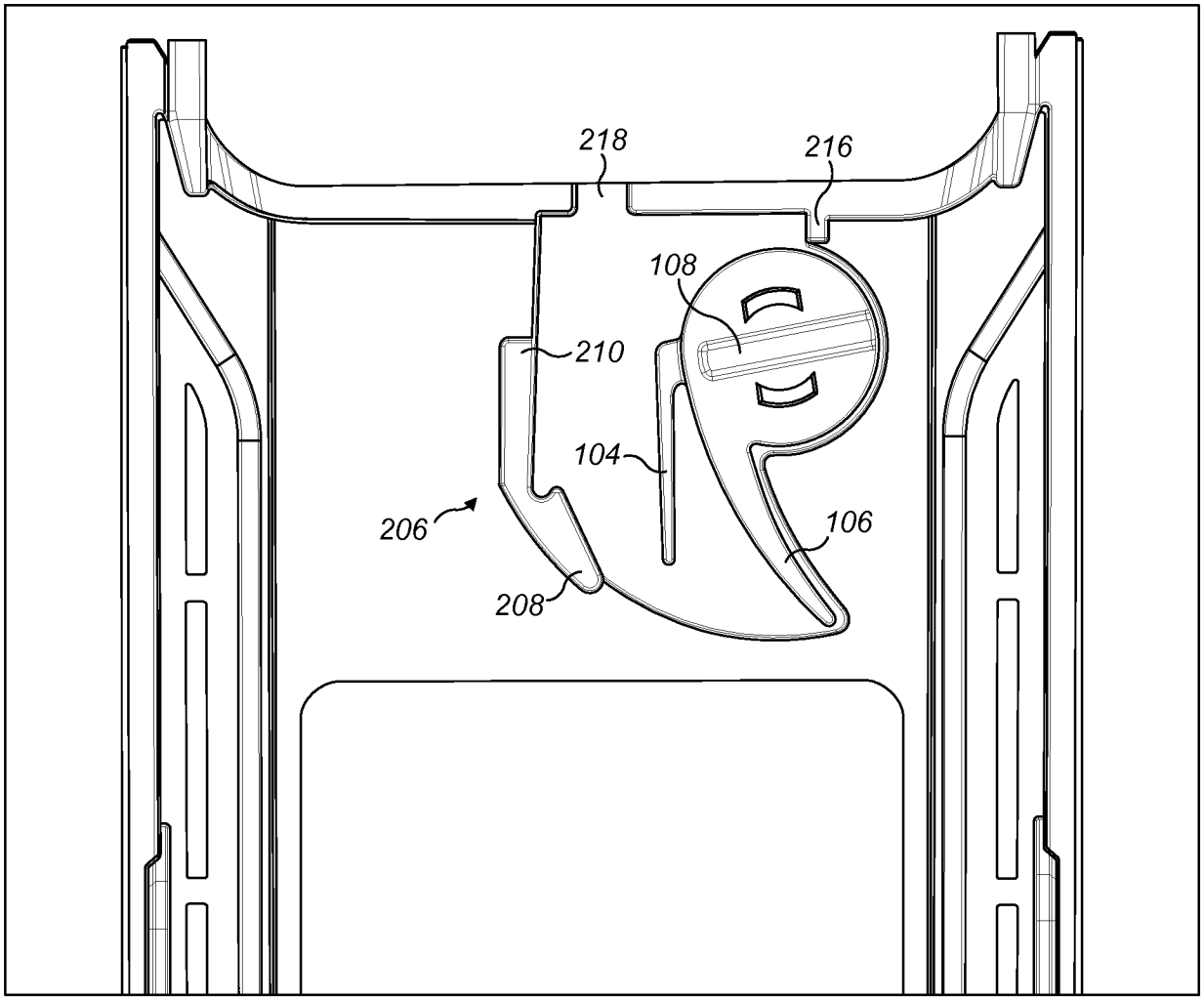

The latch receiving area 204 of cover 200 is a shallow inset area on the inner surface of the cover 200 shaped to guide the movement of the latch 100 from a non-use position to one or more operating positions. On initial insertion of the central protrusion 110 of the latch 100 into the opening 202, the latch is in the "relaxed" position. The shape of the latch receiving area 204 is such that, when the latch is in the relaxed position, only rotational movement in one direction, wherein the release arm 104 leads the rotation, is permitted. This advantageously prevents the rotation of the latch 100 in a direction whereby the latch 100 would not perform its intended function. This can be further understood from FIG. 2*b* which shows the latch 100 in the "relaxed" position.

The guiding structure 206 is a raised projection on the inside surface of the cover 200, located along an edge of the latch receiving area 204, distal to the opening 202. The guiding structure 206 has an upper portion defining a guiding edge 210 and a lower wedge-shaped portion 208 for locating the distal end of the stopping arm 106, as described in more detail below and as shown in the figures.

Figure 2C:
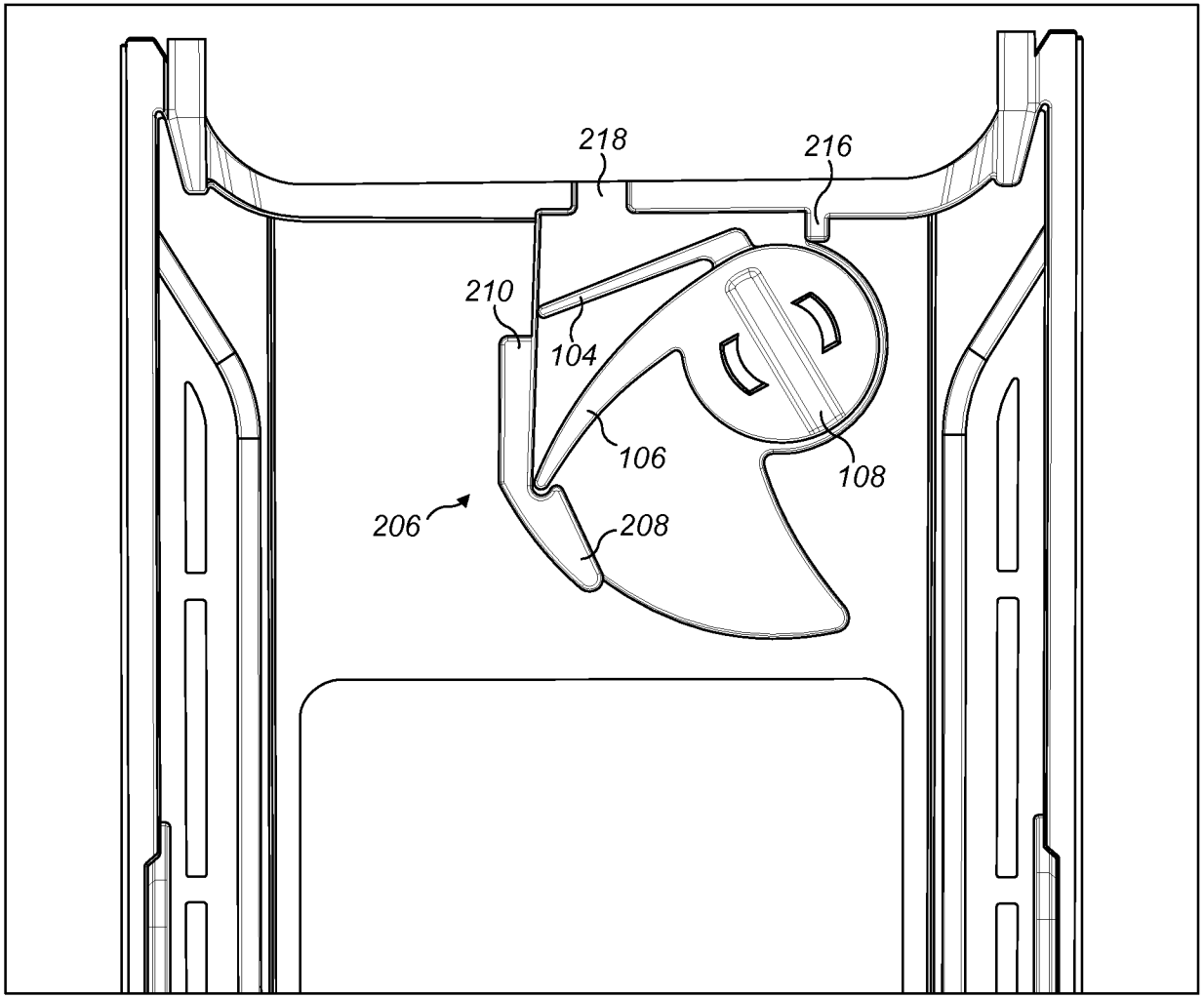

On rotation of the latch 100 from the "relaxed" position, the stopping arm 106 moves within the latch receiving area 204 in the permitted direction until a distal end of the stopping arm 106 reaches the guiding structure 206 on the perimeter of the latch receiving area 204. The shape of the guiding structure 206 is such that, upon the stopping arm 106 reaching the guiding structure 206, further rotation of the latch causes the stopping arm 106 to reach a point of no return. Therefore any further rotation of the latch 100 can only proceed further in the same direction of rotation. This control of the rotational direction is achieved due to the shape of the guiding structure 206, as described herebelow:

The guiding structure 206 juts into the latch receiving area 204, thereby reducing the space available for rotation of the stopping arm 106. The lower, wedge-shaped portion 208 of the guiding structure 206 is sloped and is aligned such that movement of the stopping arm along the wedge-shaped portion 208 is only possible if the curved stopping arm 106 is bent or compressed. Rotation of the latch 100 causes the stopping arm 106 to move along the lower portion of the guiding structure 206, simultaneously bending as it moves. This bending creates a compressive force in the stopping arm 106 which, when the stopping arm 106 has passed over the lower portion of the guiding structure 206 and reaches a lower end of the guiding edge 210, where it once again has sufficient space in which to move without bending, reverses the direction of rotation of the latch 100. This pushes the stopping arm 106 back towards the lower portion of the guiding structure 206. However, the wedge-shaped lower portion 208 has its thick end located proximal to the lower end of the guiding edge 210 and orientated with respect to that guiding edge so as to form a "seat" for the distal end of the stopping arm 106 therebetween. When the stopping arm 106 has passed the wedge-shaped portion 208 and reached the guiding edge 210, the stopping arm 106 therefore relaxes and rests in the "seat" provided by the thick end of the wedge-shaped portion 208. At this point the latch 100 is in the "operating" position as shown in FIG. 2*c*, and the guiding bar 108 is at an angle to the length of the cover 200. Due to the "seat" provided by the wedge-shaped portion 208 and the direction of curvature of the stopping arm 106, the latch 100 is unable to return to the "relaxed" position once it reaches the "operating" position.

Since the latch 100 is unable to return to the "relaxed" position once it reaches the "operating" position, it is also unable to return to a position whereby the lugs 114 of the latch 100 align with the extended regions of the opening 202. As such, once the latch reaches the "operating" position it becomes permanently fixed to the cover 200. An advantage of the permanent fixing of latch 100 to cover 200 is that there is no need to re-attach the latch once it has been fixed into its "operating" position. Additionally, the fixing requires no additional parts, for example screws, that could get lost and add additional time to the fixing process. Therefore the permanent attachment of the latch 100 to the cover 200 is quick and simple.

The guiding edge 210, defined by the upper portion of the guiding structure 206, is substantially straight and is aligned substantially parallel to the length of the cover 200. Rotation of the stopping arm 106 from the "operating" position, shown in FIG. 2*c*, towards the upper end of the cover 200 forces the distal end of stopping arm 106 to bend and move along the guiding edge 210. The further the latch 100 is rotated, the more the stopping arm 106 bends and moves along the guiding edge 210. The length of the guiding edge 210, and the length and flexibility of the stopping arm 106, are such that it is not possible to turn the latch 100 to a position whereby the end of the stopping arm 106 moves past a top end of the guiding edge 210. Due to the bending of stopping arm 106, once the rotational force on the latch 100 is released the stopping arm 106 moves back down the guiding edge 210 until it falls back into the seat between the guiding edge 210 and the wedge-shaped portion 208, thereby returning to the "operating" position. This means that, once the latch 100 is securely fitted to the cover 200, it is biased towards the "operating" position, which it needs to be in to enable the cover 200 to be fitted to a drive unit.

According to an embodiment, the guiding edge 210 of the guiding structure is located on the docking area 300 of the drive unit, instead of being an inner surface of the cover 200. In this embodiment the distal end of the stopping arm 106 can only move along the guiding edge 210 when the cover 200 is fitted over the drive unit.

The raised nature of the guiding structure 206 is advantageous in that it removes the risk of the bent stopping arm 106 slipping out of the latch receiving area 204 when the latch 100 is being rotated. The guiding edge 210 may be any shape that includes a substantially flat edge such that the end of stopping arm 106 may move along it. The location of the guiding edge 210 with respect to the opening 202 in the cover 200 must be such that the stopping arm 106 only has sufficient space to move along the guiding edge 210 if it is bent or compressed.

The stopping lug 216 is a small, raised rectangular object protruding from the frame 212 of the cover 200 and located proximal to the opening 202. The stopping lug 216 extends downwardly away from the upper end of the frame 212 and substantially parallel to the length of the cover 200, towards the opening 202. The stopping lug 216 is positioned to act as a barrier, impeding movement of the release arm 104 past the stopping lug 216 during rotation of the latch 100. It is located, shaped and sized relative to the release arm 104 so that the maximum rotation of the latch 100 is achieved when the guiding bar 108 lies substantially parallel to the length of the cover 200. At this point, the release arm 104 makes contact with the stopping lug 216 and further rotation towards the upper end of the cover 200 is impossible. This feature is important for the process of fitting the cover 200 to the drive unit, as described below. The shape of the stopping lug 216 may instead be non-rectangular, provided that it acts to stop further rotation of the release arm 104.

The recess 218 is a small cut-away area located in the upper end of the frame 212. The depth of the recess 218 is such that it lowers a section of the frame 212 to the same level as the latch receiving area 204. The shape of the recess 218 is such that it allows entry of an obstructing protrusion 306 located on a docking area 300 of a drive unit, as described further below.

Once the latch 100 has been attached permanently to the cover 200 as described above, the cover 200 can be fitted to the drive unit. This is done by sliding the cover 200 into place on the drive unit.

Figure 3A:
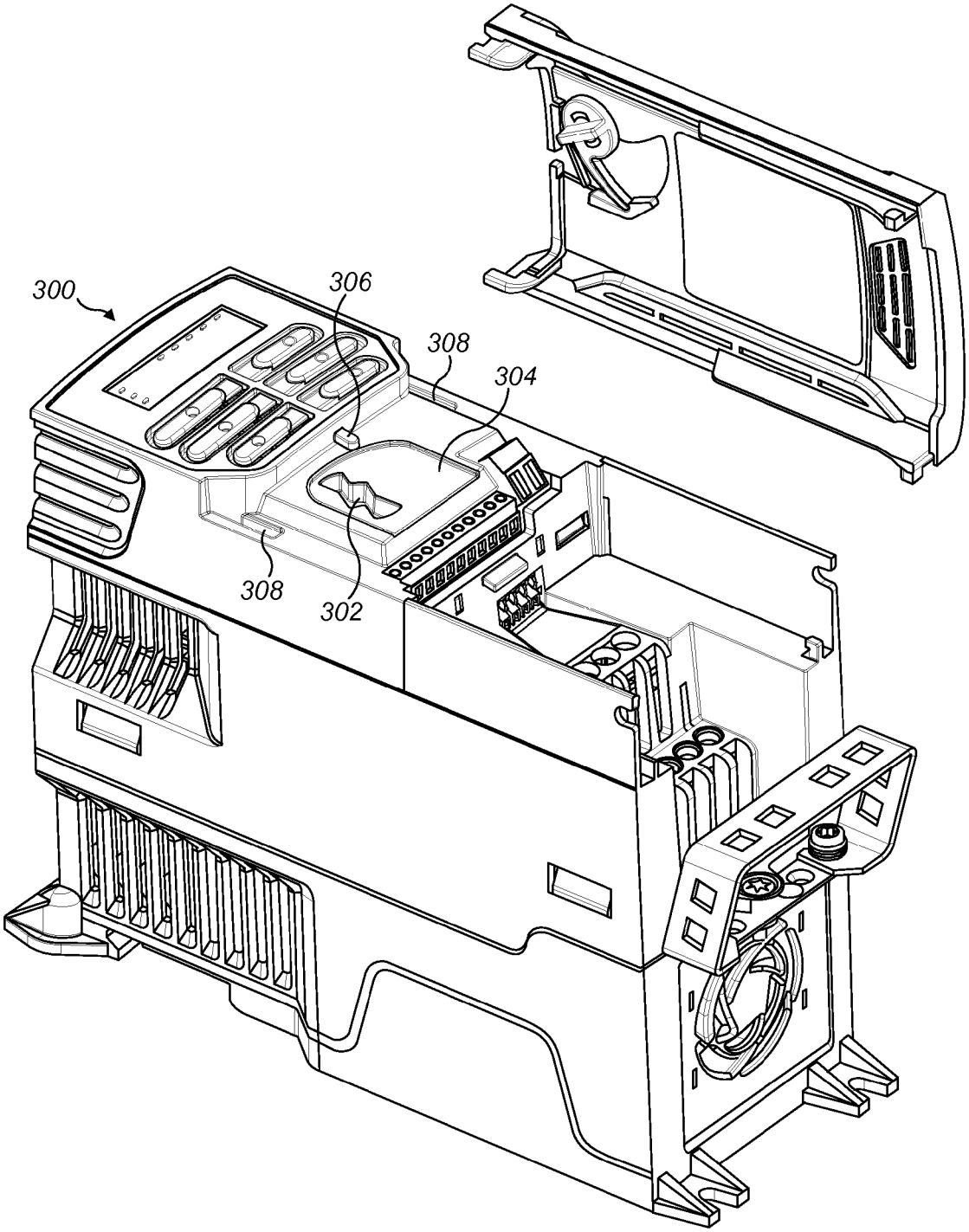
Figure 3B:
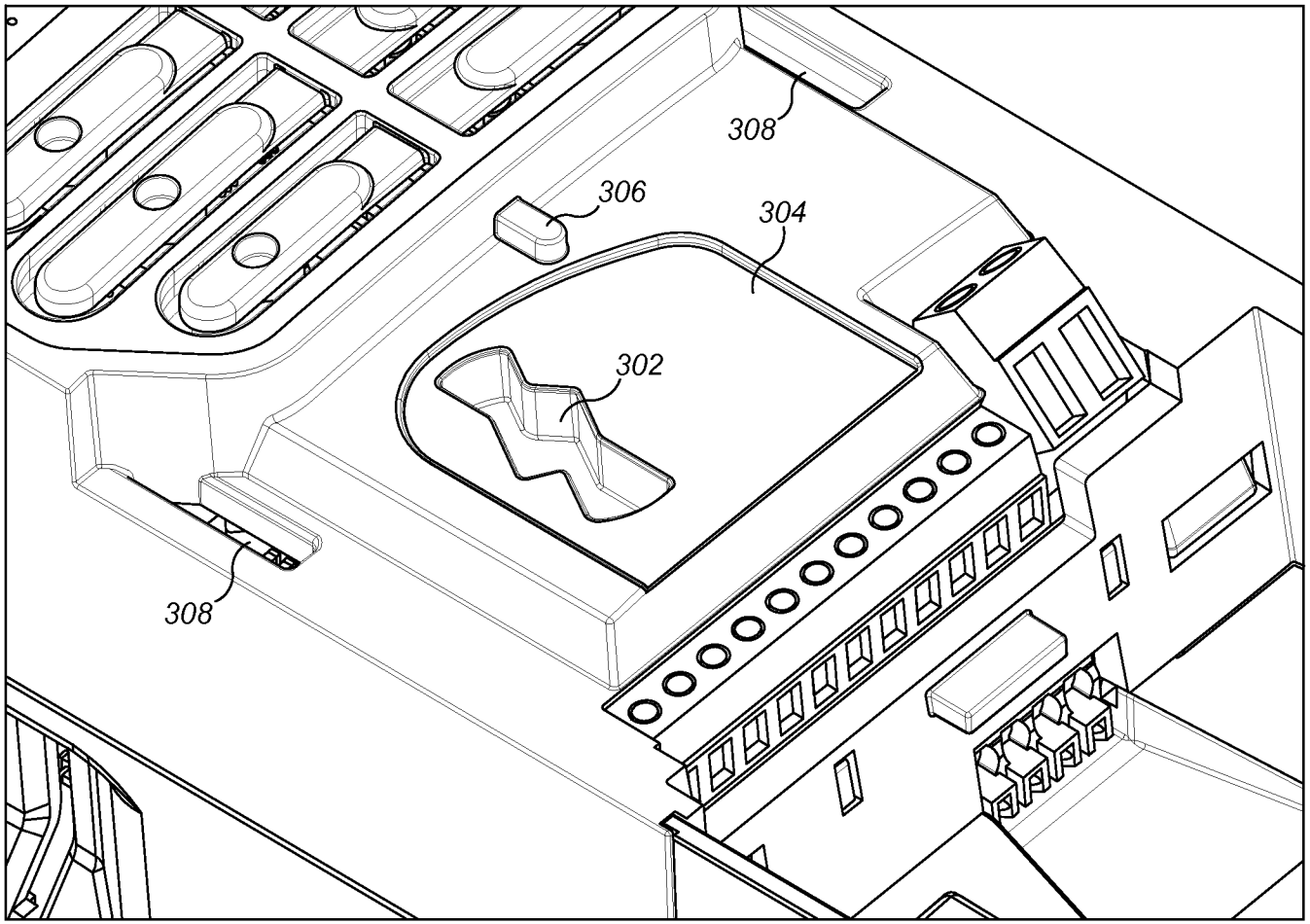

The drive unit includes an exposed region that the cover 200 is designed to fit over when attached to the drive unit. Within that exposed region, there is a docking area 300 as shown in FIG. 3*a*. The docking area 300 comprises a guiding hole 302, a terminal area 304 surrounding the guiding hole 302, an obstructing protrusion 306 and retention holes 308.

In an embodiment, the terminal area 304 is a shallow, inset region in the docking area 300 shaped to match the shape of the latch receiving area 204 and the guiding structure 206 on the cover 200. By being an inset region, the terminal area 304 allows a greater interaction between the latch 100 and the docking area 300 since the size and thickness of the latch 100 and guiding structure 206 does not need to be reduced if there are space restrictions. This allows the cover 200 to be thinner if required while still maintaining the same level of interaction in the latch mechanism.

In another embodiment, the terminal area 304 is not inset and is substantially the same level as the docking area 300. In this embodiment, the docking area 300 is simpler and is therefore easier to manufacture.

The location of the guiding hole 302 on the drive unit corresponds with the location of the guiding bar 108 of the latch 100 on the inner surface of the cover 200. The guiding hole 302 is a recess located in the docking area 300. The depth of the guiding hole 302 is sufficient to allow the insertion of the guiding bar 108 therein such that the bottom face of the body 102 of the latch 100 is able to lie substantially flush with the terminal area 304 when the cover 200 is fitted to the driving unit.

The guiding hole 302 is shaped to allow the movement of the cover 200 between two different positions with respect to the drive unit: open and closed. The guiding hole 302 has a lower section and an upper section. It also comprises a slanted region 402 which interacts with the latch 100 to move the guiding bar 108 of the latch 100 from the lower section to the upper section, and a shelf 404 which interacts with the latch 100 to reverse that movement.

Figure 4B:
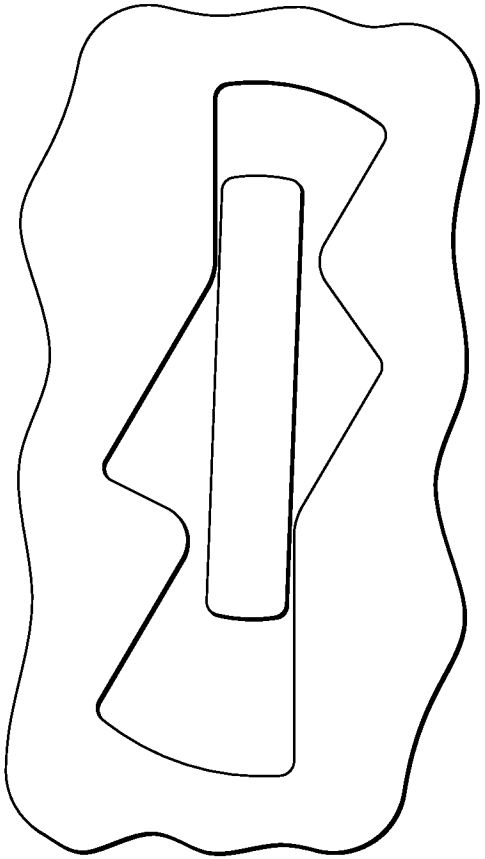
Figure 4A:
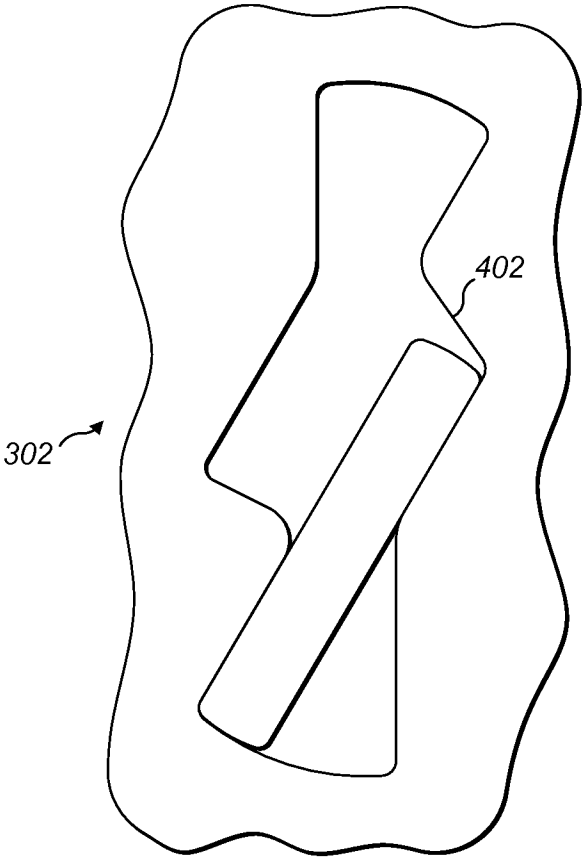

When the cover 200 is in the "open" position, the guiding bar 108 sits in the lower section of the guiding hole 302 at an acute angle to the length of the cover 200, as shown in FIG. 4*a*. The size of this angle is determined by the rotational position of the guiding bar 108 when the latch 100 is in the "operating" position shown in FIG. 2*c*. It is not possible for the guiding bar 108 to sit in the upper section of the guiding hole 302 when the cover 200 is in the "open" position due to an obstructing feature of the cover 200.

In an embodiment, the obstructing feature of the cover 200 is the hooks 214. The hooks 214 must align with the retention holes 308 to enable insertion of the hooks 214 therein. This alignment is only possible when the guiding bar 108 sits in the lower section of the guiding hole 302.

In another embodiment, the obstructing feature is achieved by a portion of the cover 200 being designed to slide into a recess in the drive unit when the cover 200 is slid into position as described below. Entry into the recess is only possible when the cover 200 is slid such that the guiding bar 108 moves from the lower section of the guiding hole 302 to the upper section of the guiding hole 302.

When the cover is slid into position, a force towards the upper section of the guiding hole 302 is applied to the guiding bar 108. This comes from the user sliding the cover 200 into place on the drive unit. The top right corner of the guiding bar 108 is therefore forced to move along the slanted region 402, thereby rotating anticlockwise and moving laterally until the guiding bar 108 has moved past the slanted region 402. As the guiding bar 108 rotates, the end of the stopping arm 106 moves up the guiding edge 210 of the cover 200. This movement causes the stopping arm 106 to bend in its direction of curvature, creating a counter force in the opposite direction of rotation. At this point, the guiding bar 108 reaches an intermediate position in the docking area 300 as shown in FIG. 4*b*. In this intermediate position, the guiding bar 108 lies parallel with the length of the guiding hole 302. As additional lateral force is applied, the guiding bar 108 surpasses the shelf 404 and as such is able to allow the latch 100 to rotate clockwise back to its "operating" position, under the influence of the counter force on the stopping arm 106. At this point, the cover 200 is in a "closed" position whereby the guiding bar 108 sits in the upper section of the guiding hole 302, shown in FIG. 4*c*.

Movement from the "closed" position of the cover 200 to the "open" position is not possible without the combination of an anticlockwise rotation of the guiding bar 108 and a sliding force. The angle of the shelf 404 is such that the bottom end of the guiding bar 108 is not able to slide down the shelf 404 in response to a sliding force alone. Therefore sliding the cover 200 into place locks it to the drive unit.

The retention holes 308 can also play a part in locking the cover 200 to the drive unit. The retention holes 308 are rectangular slots in the body of the drive unit. The retention holes each lead to a covered recess shaped to receive the right-angle bend of the hooks 214 of the cover 200. The location of the retention holes 308 corresponds to the location of the hooks 214 of the cover 200. When the cover is in the "open" position, the hooks 214 rest inside the retention holes 308. As the cover moves to the "closed" position previously described, the right angle of the hooks 214 causes the hooks 214 to slide into the covered recess and hook into the body of the drive unit such that the cover 200 advantageously cannot be moved in a direction perpendicular to the plane of cover 200. Therefore, removal of the cover 200 is only possible if a sliding motion is first performed in order to remove the hooks 214 from the recess, back into the retention holes 308, which in turn must be initiated by rotation of the latch.

In embodiments whereby the frame 212 does not contain hooks 214, the drive unit does not contain retention holes 308 but may provide an alternative mechanical connection such as a push fit or snap fit between the cover 200 and the drive unit.

An obstructing protrusion 306 of the docking area 300 is positioned such that it fits into the recess 218 in the frame 212 of cover 200 shown in FIG. 2*a*, and protrudes into the latch receiving area 204. When the cover 200 is in the "closed" position, the latch 100 is in the "operating" position as described previously. The role of the obstructing protrusion 306 is in release of the cover 200 from the drive unit, as will now be described with reference to FIGS. 5, 6 and 7.

Figure 5:
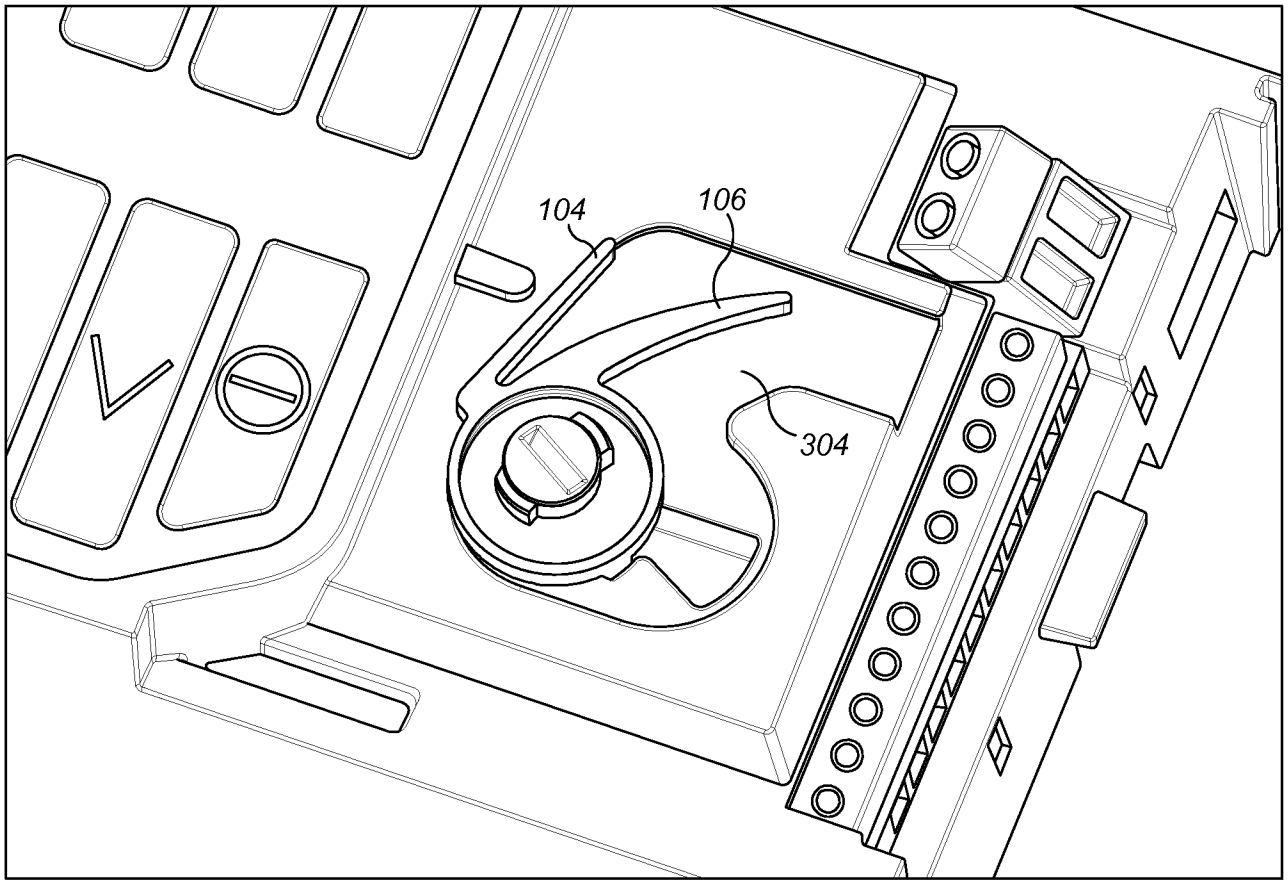
FIG. 5 shows the latch in the "operating" position of FIG. 2*c*, with the cover (not shown) of FIG. 2*a* in the "closed" position of FIG. 4*c* and located in the docking area of FIG. 3*a;*
Figure 6:
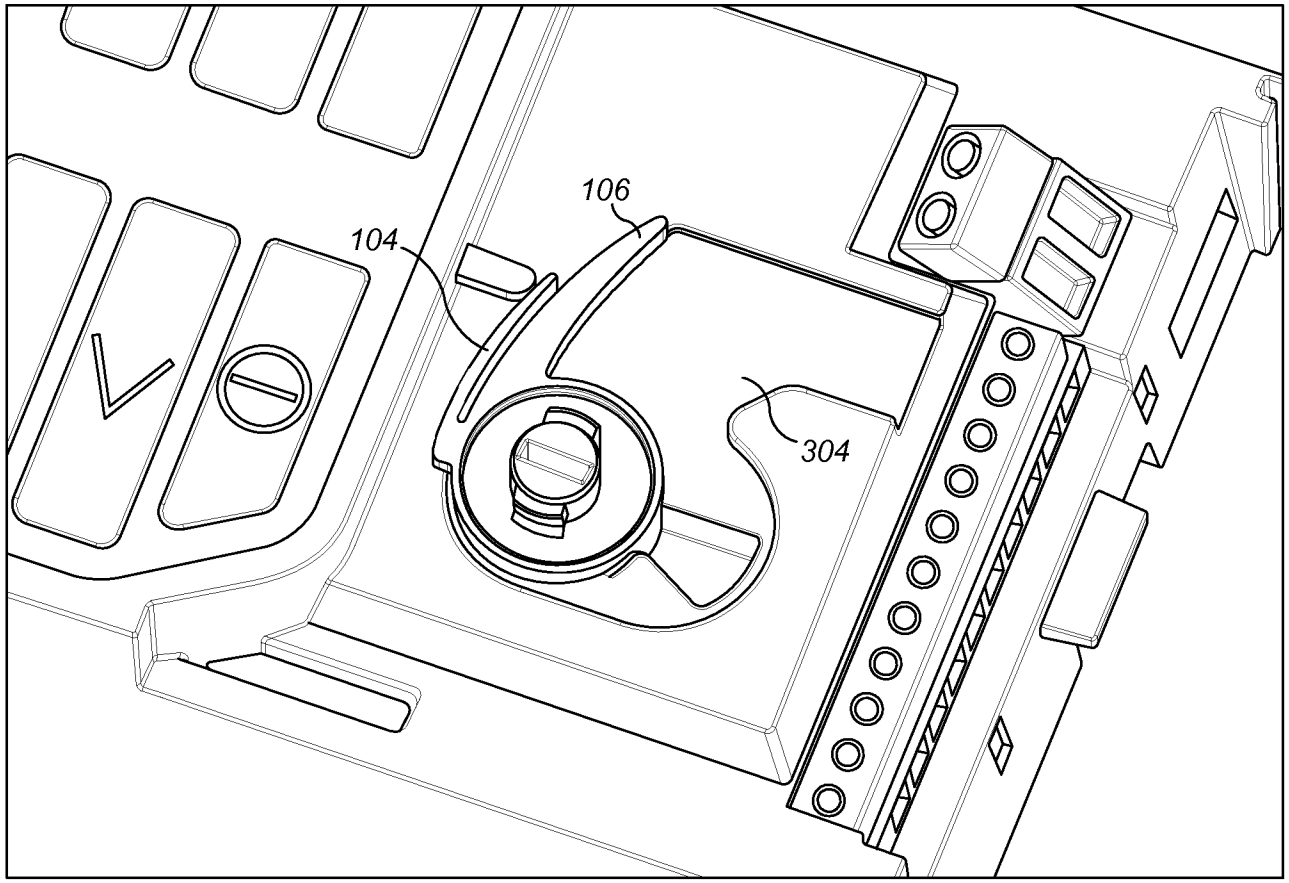
FIG. 6 shows the point of maximum rotation of the latch of FIG. 1*c* when located in the docking area of FIG. 3*a* (cover not shown)

FIG. 5 shows the latch 100 in its "operating" position, attached to the cover 200 (not shown) in the "closed" position. Further rotation of the latch 100 from the "operating" position toward the upper end of the cover 200 causes the release arm 104 to bend against the obstructing protrusion 306. FIG. 6 shows the point of maximum rotation of the latch 100 before the cover 200 is released.

Figure 7:
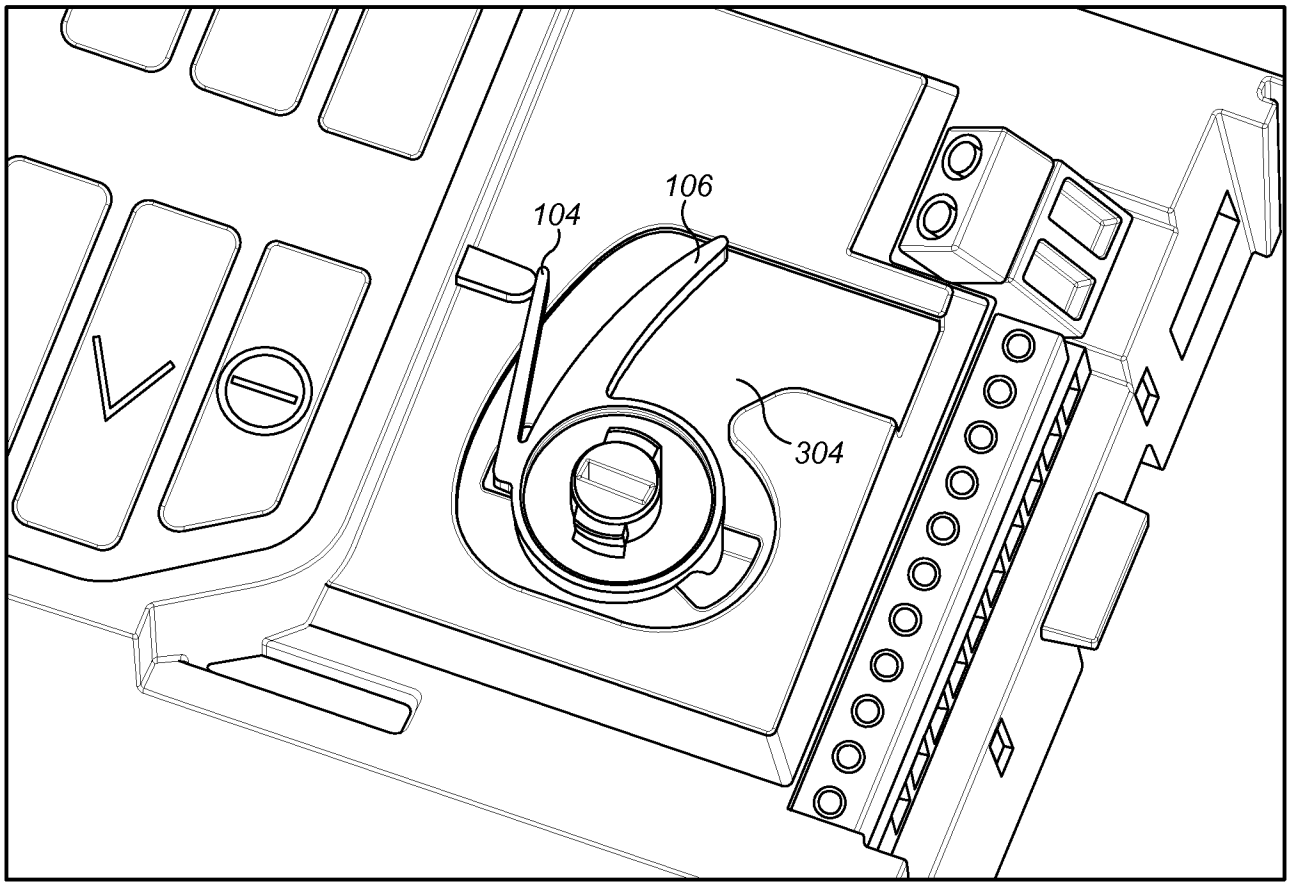
FIG. 7 shows the latch of FIG. 1*c* in the intermediate position of FIG. 4*b* (cover not shown), when located in the docking area of FIG. 3*a*.

The point of maximum rotation is reached when the release arm 104 abuts against the stopping lug 216, as described above. At this point, both the release arm 104 (against the obstructing protrusion 306) and the stopping arm 106 (against the guiding edge 210) are bent. Because it can't rotate any further to release the compression, the bending of the release arm 104 produces a force to push the guiding bar 108, and therefore the latch 100, laterally downwards past the shelf 404 via its intermediate position and towards the lower section of the guiding hole 302. Since the guiding bar 108 is parallel to the length of the guiding hole 302 when in its intermediate position as shown in FIGS. 4*b* and 7 herein, movement into the lower section of the guiding hole 302 is possible once the compressive force in the release arm is strong enough to push the guiding bar 108 past the shelf in the guiding hole 302. Thereafter, transition from this intermediate position to the "open" position of the cover 200, characterised by the position of the guiding bar 108 in FIG. 4*a*, is caused by the force resultant from the bending of the stopping arm 106 against the guiding edge 210. This causes the guiding bar 108 to rotate back clockwise from the intermediate position shown in FIG. 4*b* to the position shown in FIG. 4*a*, as the latch 100 returns to its "operating" position.

So it can be seen that the latch mechanism is highly useful for attaching covers to devices without the need for fixing agents such as screws or adhesive. Therefore the latch mechanism is a simple and safe solution which avoids lengthy cover removal and replacement times, and eliminates the risk of missing parts.

The latch 100 may be made of any suitable material or combination of materials. The material(s) of the release arm 104 and the stopping arm 106 should be resilient such that the bending of either arm is possible but does not lead to permanent deformation of the arm. For example the latch 100 may comprise plastic, metal, or any material providing appropriate properties.

The cover 200 and docking area 300 may be made of any suitable material or combination of materials. The material(s) should offer rigidity. For example the cover 200 and docking area 300 may comprise plastic, metal, wood, or any material that provides rigidity.

Whilst a particular embodiment has been shown in the figures, variants are possible without departing from the inventive concepts described herein. For example, a purpose of the stopping arm is to interact with the guiding structure in order to attach the latch to the cover, but it is possible for the latch to include a different physical feature to achieve this purpose. As another example, a purpose of the release arm is to interact with the stopping lug and the obstructing protrusion to limit the rotation of the latch and provide a force to push the latch laterally downwards, but again other physical features may be present to achieve this purpose.

These and/or other physical features of the particular embodiment described herein may be omitted or may be replaced by alternative features which serve the same (or similar) purpose in fitting a cover to a device such as a drive unit.

The relative terms "upper", "lower", "upwardly", "downwardly", "outwardly", "inwardly", "anticlockwise", "clockwise", "inner", "outer", "top", "bottom" and "lateral" used herein relate to the orientation of the device as shown in the Figures and are employed to facilitate description of the device. They are not intended to be limiting. Similarly, the use of an anticlockwise rotation followed by a clockwise rotation of the latch for fitting the latch and cover to, and removing the latch and cover from, the device is not limiting and could be reversed instead.

The invention claimed is:

1. A latch system comprising:

a latch;

a cover arranged for attachment to said latch;

wherein the latch includes a latch body comprising a stopping arm extending therefrom, the latch body further comprising a projection extending therefrom, wherein when the latch and cover are attached to one another, the projection extends from an inner surface of the cover in a first position; and a device having a docking area, said docking area being arranged to receive the latch such that said cover may be securely fixed to the device;

wherein said docking area includes a guiding recess comprising a first recess portion and a second recess portion, each recess portion arranged to receive the projection which extends from the latch body;

wherein when the projection is received in the first position in the first recess portion, a sliding movement of the cover causes actuation of the latch so that the projection moves from the first position in the first recess portion to the second recess portion and wherein when the latch is received in the second recess portion, the stopping arm provides a bias force to return the projection to the first position and further sliding movement of the cover is prevented.

2. A latch system as claimed in claim 1 wherein the latch is rotatable with respect to the cover.

3. A latch system as claimed in claim 2 wherein the latch body comprises a release arm extending from said latch body.

4. A latch system as claimed in claim 3 wherein the docking area comprises an obstructing protrusion positioned to abut against the release arm after a predetermined actuation of the latch, wherein said abuttal provides a force to help release the cover from the device.

5. A latch system as claimed in claim 1 wherein the latch comprises a first formation extending from said latch and wherein the cover or the docking area comprises a second, co-operating formation wherein the first formation will contact the second co-operating formation during actuation of the latch, in order to limit the extent of the actuation of the latch.

6. A latch system as claimed in claim 5 wherein the latch body comprises a release arm extending from said latch body, and wherein the first formation extending from the latch is incorporated into the release arm.

7. A latch system as claimed in claim 6 wherein the second formation is a stopping lug.

8. A latch system as claimed in claim 1 wherein the cover or the docking area comprises a guiding structure comprising a first, wedge-shaped portion and a second portion including a guiding edge.

9. A latch system as claimed in claim 8 wherein actuation of the latch causes a distal end of the stopping arm to sit in a seat formed between the wedge-shaped portion and the guiding edge of the guiding structure, thereby locking the latch to the cover.

10. A latch system as claimed in claim 9 wherein an actuation of the latch after said latch is locked to the cover causes the stopping arm to bend and bias the movement of the latch back to a position whereby the distal end of the stopping arm sits in the seat formed between the wedge-shaped portion and the guiding edge.

11. A latch system as claimed in claim 1 wherein the latch comprises a slot to enable rotation of the latch via a tool.

12. A latch system as claimed in claim 11 wherein the slot is shaped to accommodate the head of a screwdriver.

13. A latch system as claimed in claim 1 whereby the latch comprises opposite first and second faces, said first face having the projection and said second face having a protrusion thereon.

14. A latch system as claimed in claim 13 wherein the latch comprises a slot to enable rotation of the latch via a tool, and wherein the slot is located on the protrusion.

15. A latch system as claimed in claim 14 wherein the slot is shaped to accommodate the head of a screwdriver.

16. A latch mechanism as claimed in claim 15 wherein the protrusion is shaped to be rotatable by a tool directly.

17. A latch system as claimed in claim 1 wherein the cover comprises an opening arranged to receive at least a portion of the latch.

18. A latch system as claimed in claim 1 wherein the cover further comprises one or more hooks extending from said cover.

19. A latch system as claimed in claim 18 wherein the docking area comprises one or more retention holes arranged to receive one or more of the hooks on the cover.

20. A latch system as claimed in claim 1 wherein the first and second recess portions of the guiding recess are arranged offset from one another in the direction of sliding of the cover.

* * * * *